United States Patent [19]

Engel

[11] Patent Number: 4,933,820

[45] Date of Patent: Jun. 12, 1990

[54] LIGHTING SYSTEM

[76] Inventor: Hartmut S. Engel, Schloss Heutingsheim, Freiberg am Neckar, Fed. Rep. of Germany, 7141

[21] Appl. No.: 365,587

[22] Filed: Jun. 13, 1989

Related U.S. Application Data

[62] Division of Ser. No. 136,689, Dec. 22, 1989, Pat. No. 4,876,633.

[30] Foreign Application Priority Data

Dec. 23, 1986 [DE] Fed. Rep. of Germany ..... 3644335

[51] Int. Cl.[5] ..... F21S 3/02

[52] U.S. Cl. ..... 362/217; 367/221; 367/225; 367/367

[58] Field of Search ..... 362/217, 221, 223, 225, 362/224, 260, 367

[56] References Cited

U.S. PATENT DOCUMENTS

| | | | |
|---|---|---|---|
| 2,281,379 | 4/1942 | Ohm | 362/223 |
| 2,525,315 | 10/1950 | Schepmoes | 362/223 |
| 2,623,160 | 12/1952 | McPhail | 362/223 |
| 2,874,271 | 2/1959 | Lipscomb | 362/223 |
| 4,338,653 | 7/1982 | Marrero | 362/223 |
| 4,667,275 | 5/1987 | Herst et al. | 362/223 |

*Primary Examiner*—Ira S. Lazarus
*Assistant Examiner*—Sue Hagarman
*Attorney, Agent, or Firm*—Townsend and Townsend

[57] ABSTRACT

A lighting unit, especially for a lighting system is described and is characterized by a carrier section which has a flattened elongate cross-section which terminates in acute angles at both ends, with all functional elements being concentrated in the central part which always has the largest vertical dimension. Changes of the dimensions lead, as a result of the selected layout to no substantial change in the outer appearance, so that powerful systems can also be realized with the same shape without impairing the external appearance.

1 Claim, 3 Drawing Sheets

LIGHTING SYSTEM

Figure 1:
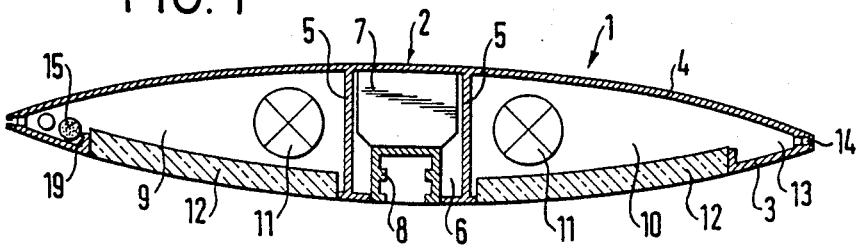

This is a division of application Ser. No. 07/136,689 filed December 22, 1989 now U.S. Pat. No. 4,876,633.

The invention relates to a lighting unit, especially for use in a modular lighting system, in particular for generating light band type lighting structures comprising an elongate carrier section for receiving fluorescent lamps with caps holders at both ends and associated functional elements in the form of chokes, reflectors, translucent covers and the like.

Known arrangements of this kind consist of tubular or box-like housings in which a fluorescent lamp or several fluorescent lamps are accommodated together with the electrical functional elements. In order to provide light band type lighting structures these housings can be coupled together at their end faces either directly or via connection parts. The tubular or box shape of these known arrangements prevents the achievement of continuous light bands in a small volume layout because electrical functional elements, in particular chokes, must always be repeatedly arranged between lamps which follow one another in a longitudinal direction. This has the consequence, in larger volume layouts, when several fluorescent lamps are to be accommodated in one housing, that systems result which are, on the one hand, aesthetically unsatisfying and of plump appearance and, on the other hand, that unfavourable radiation angles and inadequate efficiencies are obtained.

It is the object of the invention to develop a lighting unit of the initially named kind in such a way that the integration of the electrical functional elements into the carrier section has practically no affect on the appearance of the lighting unit, and consequently that enlargements and reductions in size of the basic shape are possible without this leading to a change in the aesthetic appearance thereof. Simultaneously it is the intention to achieve improvements of the efficiency, of the radiation angle and of the shading possibilities which make it possible to take account of diverse requirements from the technical lighting and room layout viewpoints through the possibility of direct, indirect and regionally concentrated lighting.

This object is satisfied essentially in that the carrier section has a flattened elongate cross-section which terminates in acute angles at both ends; and in that a chamber-like accommodation region electrical functional elements, or at least one fluorescent lamp, is formed in the central part of the carrier section which has the largest height.

Through the provision and consequential use of such a carrier section for technical lighting purposes, with the carrier section preferably having the shape of a centrally symmetrical convex lens in cross-section, it is possible, in contrast to systems with other cross-sectional shapes, in particular systems with round or rectangular cross-section of shapes, to enlarge the basic structure which is intended, for example, for one fluorescent lamp to accommodate several fluorescent lamps without proportionally or approximately proportionally increasing the volume. Independent of the particular lighting power and the size of the lighting unit, the outer appearance of the lighting unit thus remains practically unchanged. This is in particular a consequence of the fact that a space ideally suited for the accommodation of functional elements is available in the central part of the lamp as a result of the selected structure, with the volume of this space changing greatly with a small reduction or increase in the outer contour of the carrier section. This has a particularly favourable effect when increasing the external dimensions because even comparatively small increases in size of the external dimensions in the central region provides so much additional space that any additionally necessary electrical functional elements can be accommodated without problem.

Particularly advantageous embodiments of the invention are set forth in the subordinate claims.

Figure 2:
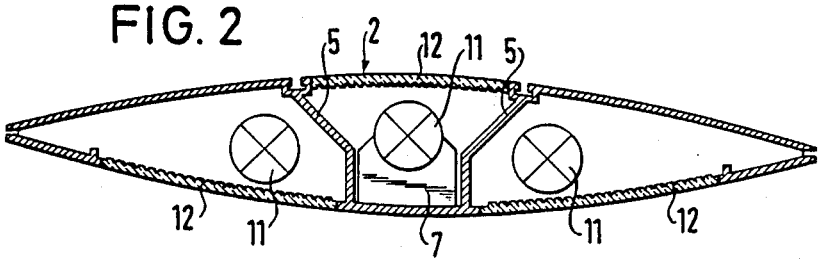
Figure 3:
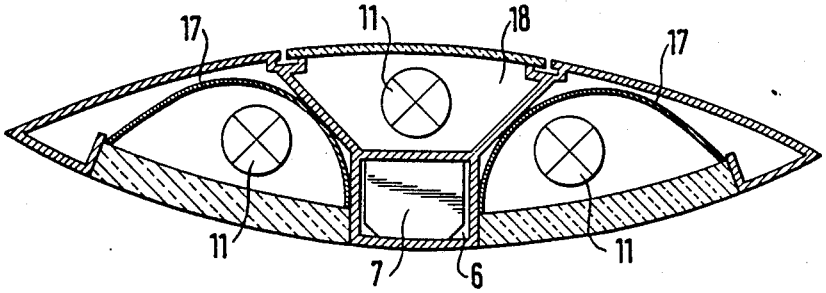
Figure 4:
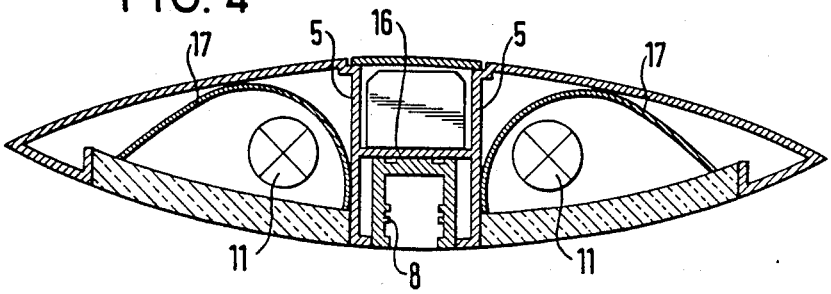
Figure 5:
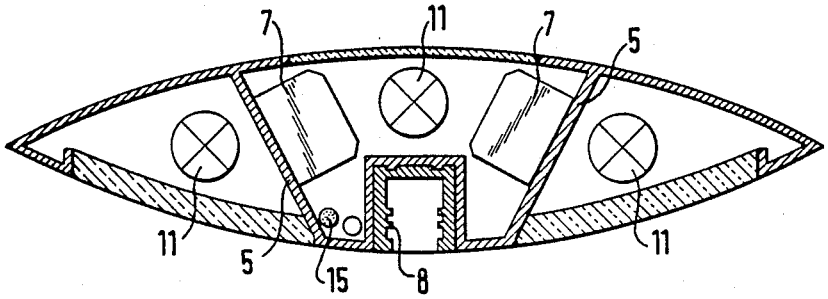
Figure 6:
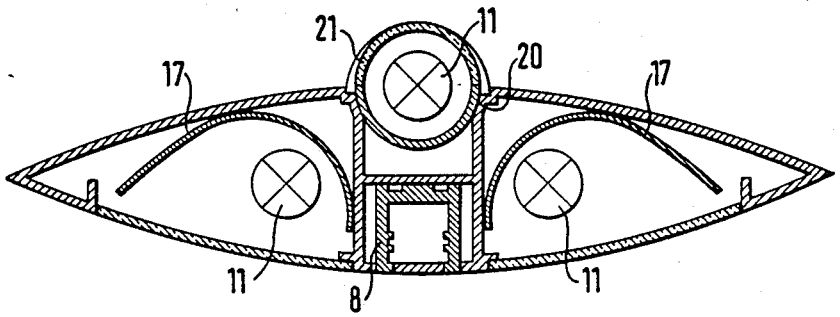
Figure 7:
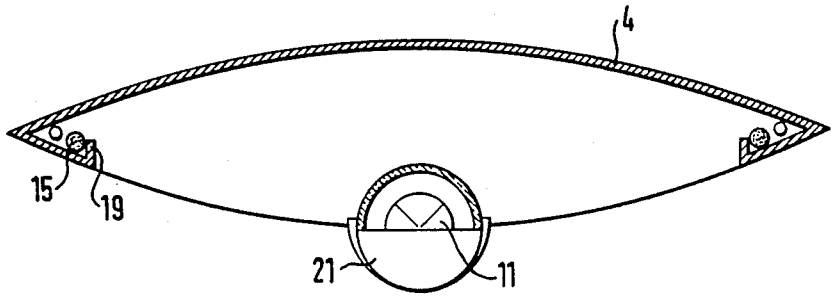
Figure 8:
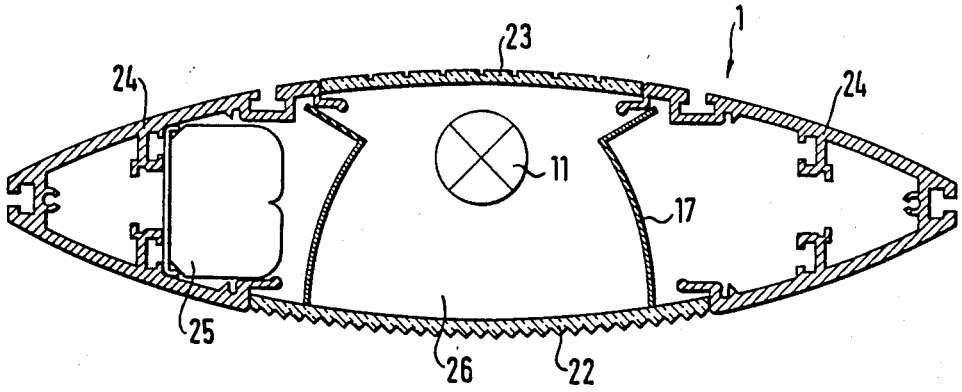

The invention will now be explained in more detail by way of embodiments with reference to the drawing in which are shown:

FIG. 1 a schematic representation of a first embodiment of a lighting unit in accordance with the invention, FIG. 2 a variant for direct and also for indirect lighting, FIG. 3 a modification of the light of FIG. 2, FIG. 4 a layout for the light of the invention for the simultaneous direct and optionally pointwise illumination via additional lamps, FIG. 5 an embodiment intended for increased lighting power for direct, indirect and optionally point-like illumination, FIG. 6 a schematic representation to explain the principle of the connection of several lighting systems with one another, FIG. 7 a schematic representation to explain a further variant of the invention, and FIG. 8 a schematic illustration of a further preferred embodiment of the invention.

The schematic cross-sectional view of FIG. 1 shows a carrier section 1 which has in particular been made by extrusion and which has the shape of a centrally symmetric, relatively shallow convex lens. This carrier section 1 is bounded essentially by two curved surfaces in the form of an upper shell part 4 and a lower shell part 3, with the upper shell part 4 being closed over its full area in this embodiment, whereas the lower shell part 3 has cut-outs to accommodate translucent covers 12.

A central part 2 is bounded in the carrier section 1 by vertical webs 5 which connect the two shell parts 3 and 4 together. The central part forms an accommodation region 6 for electrical functional elements, in particular for a choke 7 and, in the illustrated case, forms a power rail 8.

Profiled chambers 9, 10 in which fluorescent tubes 11 are arranged are located on both sides of the central part 2. The associated lamp holders are mounted on the end walls at the end faces of the carrier section. The shallow side regions of the profiled chambers 9, 10 are formed as stowage chambers 13 for electrical cables 15 and lines. For this purpose it is merely necessary to form an approximately vertical web 19 on the lower shell part which can be simultaneously exploited to hold the translucent covers 12. The vertical web 19 extends over only part of the height of the profiled chamber so that the respective stowage chamber 13 is accessible via a slot for the laying in of the lines. In order to generate a narrow lateral band of light the corner parts 14 of the carrier section 1 are formed with an accommodation slot for a material which concentrates light. These slots communicate with the profiled chambers 9, 10 via openings so that light can emerge through the openings and thus these narrow light bands can become effective.

Whereas the profiled chambers 9, 10 have a favourable effect with regard to the desired radiation angle and also the efficiency, as a result of their width, the height of the central part 2 makes it possible to accommodate all the electrical functional elements, in particular chokes, and also to accommodate any additional current rails which are provided without problem. In so doing the layout of the carrier section ensures a high mechanical strength as a consequence of the box construction which forms the central part 2.

FIG. 2 shows an embodiment which, in addition to the direct illumination given by the FIG. 1 embodiment, also makes indirect illumination possible by means of a further fluorescent tube 11 arranged in the central part 2. In this arrangement a choke 7 is still arranged in the central part 2, the vertical webs 5 are however made upwardly divergent so that a favourable radiation angle can be obtained over the translucent cover 12. Despite this additional possibility for simultaneously providing indirect illumination, the external dimensions of the carrier section are only insignificantly changed.

FIG. 3 shows an embodiment in which the vertical dimension is increased while retaining the width dimension. This provides, while retaining the basic shape, accommodation chambers for reflectors 17 to generate a desired direct illumination and a special receiving chamber 18 for a fluorescent tube 11 to achieve indirect illumination.

The central part 2 includes in this arrangement a receiving region 6 for the choke 7, and optionally for further electrical functional elements, and also a diverging chamber which lies above it for accommodating the fluorescent tube 11.

A comparatively small increase in the height of the central part of the carrier section leads to the availability of an additional receiving chamber or radiating chamber 18 without impairing the possibilities for accommodating the electrical functional elements. Moreover, it provides a comparatively large degree of freedom with regard to the layout, i.e. the position and curvature of the reflectors 17 for the direct illumination.

The variant of FIG. 4 makes it clear that the large area direct illumination which can be obtained by special layout of the reflectors can be combined without difficulties with, for example, a point-like illumination in as much as a current rail 8 fixed in the centerpart is integrated into the carrier section and is suitable for accommodating customary spot lamps. In this case also all electrical functional elements are again concentrated in the central part, which is favourable spacewise. The central part is also particularly suited for accommodating these partly heavier elements as a result of its mechanical stability which is brought about by the chamber structure.

The embodiment of FIG. 5 makes it clear that the space available within the carrier section can also be ideally used in the case of a combination of direct, indirect and for example pointwise illumination and for accommodating the electrical functional elements necessary for this combined illumination, and that the necessary mechanical stability is simultaneously given by a corresponding layout of the profiled section. No change of the basic shape of the carrier section results despite the fact that space is made available for oppositely disposed chokes in the central part of FIG. 5, that a current rail 8 is integrated into the lower side of the structure and that accommodation regions for cables 15 and lines are made available in this embodiment. An increase in the size of the carrier section height accordingly leads to an increase in volume which is at once notable in the central part intended to accommodate the function elements, but does not however change the overall structure and thus the appearance of the light system in any notable manner.

FIG. 6 shows a way of connecting several lighting systems in series by connection via tubular elements 21. For this purpose coupling mounts 20 for tubular elements are provided in the carrier section, in particular at its upper side so that simple plug couplings result. These tubular elements can also be fixedly integrated into the region of the profiled sections so that a continuous tubular structure results which can simultaneously be laid out - as indicated in FIG. 6 - so that parts of the tubular wall are of translucent construction and a fluorescent tube 11 is arranged in the connection tube. In this manner the possibility is obtained of achieving indirect illumination by exploiting the connection elements, which in turn leads to a favourable overall structure with a comparatively small height of the carrier section.

FIG. 7 shows an embodiment in which a tubular element 21 is provided at the lower side of the carrier section and is held at its end faces. This tubular element can also be coupled with further extending tubes. A fluorescent tube 11 is arranged in the tubular element 21 in such a way that it is shielded towards the bottom and radiation is achieved via reflection at the upper shell part 4.

In accordance with a further special feature of the invention the center parts and the side parts can be separately made and can be coupled to one another, in particular can be clipped together so that a modular arrangement is obtained which makes it possible to construct one or two part lamps.

FIG. 8 shows a preferred embodiment in which the carrier section 1 which has the shape of a convex lens consists of two identically constructed lateral profiled parts 24 and a central region 26 which serves to accommodate one or more fluorescent tubes 11 and corresponding reflectors 17. The lateral profiled sections 24 are provided with continuous webs, cut-outs and undercuts in such a way that simple coupling connections can be achieved with translucent or non-light-permeable covers 23, arrays or grids of shields or scattering disks 22 associated with the central region 26. Furthermore, chambers for accommodating the functional units 25 are formed in the lateral parts of the carrier section.

While the lateral parts of the section together with the mutual connection therebetween represent a permanent basic structure which remains unchanged in this embodiment the central region 26 can be equipped in different manner with reflectors, covers and fluorescent tubes so that different radiation characteristics can be achieved at one or both sides and thus the requirements in practice for a type of a modular system can be taken into account in a particularly economic manner.

The variants of the invention which have been indicated by way of example make it clear that the special cross-sectional shape of the carrier section provides high variability with regard to the radiation angle and also the shading possibilities with high efficiency always being present. These advantageous characteristics are paired with high stability and ideal weight distribution and in all embodiments the external appearance remains practically unchanged despite different height dimensions.

I claim:

1. Elongate light unit for use in a modular lighting system for generating light band type structures, said lighting unit comprising:

an elongate carrier section having a cross-section resembling a double convex lens and being composed of two identically constructed, extruded, lateral profiled section each having an essentially V-shaped cross-section with an apex and ends, defining a mouth, opposite to said apex;

means connecting said lateral profiled sections together at said ends with said apices forming respective longitudinal side edges of said lighting unit and with said mouths confronting each other but spaced apart from each other, whereby to form a central chamber between said lateral profiled section and side chambers within said lateral profiled sections:

at least one fluorescent tube received within said central chamber;

functional means comprising a choke and electrical cables and optionally other functional elements disposed in at least one of said side chambers;

said lateral profiled sections including continuous webs, and undercuts forming coupling connection with modular elements to be mounted in said central region above and below said at least one fluorescent tube, said modular elements comprising translucent covers, non-light permeable covers, shield arrays and scattering grids;

reflectors provided to the sides of said at least one fluorescent tube with said reflectors extending across the mouths of the respective associated lateral profiled sections, wherein said apices are slotted at said longitudinal side edges to form mounts, wherein strip-like light concentrating material is disposed in said mounts and wherein said slots communicate with said side chambers.

* * * * *